US005666743A

United States Patent [19]

Dawson

[11] Patent Number: 5,666,743

[45] Date of Patent: Sep. 16, 1997

[54] APPAREL DRYING AND DEODORIZING SYSTEM

[76] Inventor: Bonnie D. Dawson, 360 Sarratt School Rd., Gaffney, S.C. 29341

[21] Appl. No.: 606,556

[22] Filed: Feb. 26, 1996

[51] Int. Cl.[6] ..... F26B 19/00

[52] U.S. Cl. ..... 34/219; 34/202

[58] Field of Search ..... 34/218, 219, 202, 34/233, 225

[56] References Cited

U.S. PATENT DOCUMENTS

| | | | |
|---|---|---|---|
| 16,110 | 7/1856 | Savard . | |
| 1,258,633 | 3/1918 | Heath . | |
| 1,500,094 | 7/1924 | Kee | 34/233 |
| 1,598,660 | 9/1926 | Sieben | 34/233 |
| 1,658,489 | 2/1928 | Lindstrom . | |
| 1,688,793 | 10/1928 | Schrenkeisen . | |
| 1,693,308 | 11/1928 | Merkowitz | 34/218 |
| 1,830,323 | 11/1931 | Judelson et al. | 34/233 |
| 2,111,148 | 3/1938 | Judelson | 34/225 |
| 2,134,493 | 11/1938 | Chadeayne | 34/225 |
| 2,267,158 | 12/1941 | Locke . | |
| 4,625,432 | 12/1986 | Baltes | 34/202 |
| 4,677,764 | 7/1987 | Cerny | 34/195 |
| 5,379,525 | 1/1995 | Raynor | 34/104 |
| 5,546,678 | 8/1996 | Dhaemers | 34/275 |
| 5,555,640 | 9/1996 | Ou | 34/202 |

FOREIGN PATENT DOCUMENTS

| | | | |
|---|---|---|---|
| 2220695 | 9/1990 | Japan | 34/202 |

*Primary Examiner*—Henry A. Bennett
*Assistant Examiner*—Dinnatia Doster
*Attorney, Agent, or Firm*—Robert Reed

[57] ABSTRACT

The apparel conditioner system of this invention includes an apparel conditioning device that can be used to dry and deodorize apparel. The apparel conditioning device can be supported inside an outer enclosure to comprise an apparel conditioner system used to improve the deodorizing of apparel along with drying the apparel. The apparel conditioning device includes a fan to force ambient air through an air passage defined within a housing of the apparel conditioning device. An adjustable apparel rack is positioned within the air flow passage using an adjustable rack mount. The position of the apparel rack is selected for supporting and holding the apparel such that a flow of ambient air can circulate to the inside surfaces of apparel having an inside surfaces and envelop the outside surfaces of the apparel at the same time. The fan has a speed adjustment to obtain a velocity of the flow of the ambient air to improve the circulation in and envelopment around the apparel. Apparel includes not only any article of clothing but also sporting gear.

16 Claims, 5 Drawing Sheets

APPAREL DRYING AND DEODORIZING SYSTEM

BACKGROUND OF THE INVENTION

This invention relates to an apparatus for drying and deodorizing articles of clothing, and more particularly to a fan and housing inside an outer enclosure where a flow of ambient air is blown into and around apparel for improved drying and deodorizing. The system conditions apparel without the addition of a heating element and is portable.

Articles of apparel which were made of leather or plastic in the past are more frequently being made of natural and synthetic fabrics. This trend is for reasons of economy and fabric materials have become the preferred clothing material for the casual lifestyle of the young and old alike. However, many of these materials have less resistance to penetration by water and frequently become soiled and must be washed. For example, the type of shoes, gloves and hats which have become popular items of apparel are much less resistant to penetration by water and must be frequently washed. These articles of apparel also absorb odors and must be frequently "aired-out" to become more pleasing to a person's sense of smell. Frequent drying and deodorizing of these articles of apparel is required. The use of a household dryer is a very inefficient means for drying and deodorizing these articles of apparel. A full dryer load of shoes is not normally possible and a pair of shoes may cause damage to the dryer; in addition to being very noisy during the drying process. In addition, the use of dryers for sporting events has become greater as the health and performance of athletes has been found to critically depend on the condition of sporting gear.

A number of devices have been described for drying individual items of clothing. Two typical examples of these devices are disclosed in U.S. Pat. Nos.: 1,688,793 and 5,379,525.

In the disclosure of Schrenkeisen (U.S. Pat No. 1,688,793) a shoe dryer is disclosed where heated air from header section flows into a shoe and sock drying compartment including a shelf to support the shoes being dried. The effect of making turbulent the flow of air in the header section directs the air through ducts between the header section and the drying compartment into shoes supported on the shelf. This patent teaches using two compartments connected by ducts and adding heat to the air for drying. No adjustment in the shelf is provided for improving the drying process.

In the disclosure of Raynor (U.S. Pat. No. 5,379,525) a hair dryer is used to provide heat and air to dry boots, gloves and the like. A box shaped enclosure includes one open side and one side for locating the hair dryer within an opening. A drying rack is used to support the gloves such that an opening into the interior of the gloves is positioned immediately below the hair dryer nozzle. Alternately, a removable dryer shelf is used to support objects being dried. This drying stand does not disclose an adjustable stand and heat is provided during the drying process.

Other patents for heating and conditioning shoes are disclosed in U.S. Pat. Nos. 1,258,633 and 2,267,158 and U.S. Pat. No. Re. 16,110. These patents disclose both the drying of shoes and softening of leather used to make shoes.

The patents of Heath (U.S. Pat. No. 1,258,633) and Savard (U.S. Pat. No. Re 16,110) both disclose a shoe support that adjusts to support the shoe to vary the amount of heat received by the outside surface of the shoe. The shoe is softened by the heating means and no air supply means is disclosed or necessary with these shoe softeners.

The shoe fitting stool of Locke (U.S. Pat. No. 2,267,158) includes a supply of heated air from within a casing through a grill for drying a shoe or a foot having a sock. The position of the foot is not adjusted by the stool structure to allow for the direction of the heated air flow within the stool.

The use of an enclosure for generating heated air for electrically drying the foot is also disclosed in U.S. Pat. No. 1,658,489. This disclosure of Lindstrom teaches using a box with a fan of blower driven by a motor having a foot operated switch. The box includes a heater and a baffle for deflecting heated air up through a screen for foot drying. This portable foot drying machine does not teach how to adjust the position of the foot for optimum drying, and the air is again heated.

The need remains to have an efficient system for the drying of apparel which has become wet by use or when washed. The elimination of any heating element is essential for the economic operation of the system. The absence of heat makes the position of apparel within a flow of ambient air essential to drying in a reasonable amount of time. The problems associated with deodorizing articles of apparel also need to be solved along with the needs for drying. Both drying and deodorizing of apparel should be accomplished by the same system at the same time.

Accordingly, an object of the present invention is to provide a system which uses ambient air to dry and deodorize apparel of various types and size.

Another object of the present invention is to provide a housing where apparel can be positioned in an air passage to provide the correct location to achieve drying without the addition of a heating element to an ambient air supply.

A further object of this invention is to provide a portable unit that can be easily stored and retrieved to provide a conditioning device for apparel as needed. The unit should be light in weight and provide cost effective means for drying and deodorizing for the private individual.

An additional object of the present invention is to provide an apparel conditioner system and method which can be used to deodorize apparel without exhausting foul air into a room where it is being used. In this mode the ambient air should be recirculated and essentially not exhausted into the room.

Yet another object of the present invention is to provide an adjustable support means for the apparel being conditioned to be place in the air passage to allow a flow of air to circulate in contact with the inner surfaces of the apparel and at the same time envelop the outside surfaces of the apparel.

A further object of the present invention is to provide a device and system for drying apparel related to sporting events including all types of sporting gear.

SUMMARY OF THE INVENTION

The above objectives are accomplished according to the present invention by providing an apparel conditioner system having an apparel conditioning device including a housing, a fan to establish an flow of ambient air in an air passage and an adjustable rack mount to position the apparel in the air passage. The device further includes a fan control device to adjust the flow of ambient air such that optimum drying and deodorizing can be accomplished within a given amount of lapsed time. Alternately stated, the time it takes to achieve an acceptable amount of drying and deodorizing is kept to a relative minimum amount of lapsed time. An outer enclosure can also be provided for improving the deodorizing of apparel and provide drying of the apparel at the same time.

The present invention is an apparel conditioner system is for drying and deodorizing apparel with a flow of ambient air. The system comprises an apparel conditioning device including a housing having an external surface, an inlet and an outlet. An air flow passage, defined within the housing between the inlet and the outlet in which the flow of ambient is established, conditions the apparel within the housing. A fan, carried by the housing and positioned in the inlet of the housing, forces the flow of ambient air through the air flow passage and out the outlet end of the housing. An adjustable apparel rack is carried within the housing for supporting the apparel in a position to be conditioned. An adjustable rack mount positions the adjustable rack in the air flow passage at an angle with respect to the housing such that the angle of the rack with respect to a bottom wall surface of the interior surfaces of the housing provides an improved flow of ambient air within the air flow passage. The improved flow of ambient air circulates ambient air to inside surfaces of the apparel and envelops outside surfaces of the apparel at the same time. The system includes an outer enclosure having an inner surface for receiving and containing the apparel conditioning device within the outer enclosure. An air gap channel is provided by displacing the exterior surface of the housing from the inner surface of the outer enclosure. The air gap channel is for recirculating ambient air within the outer enclosure from the outlet of the housing to the inlet of the housing for providing the flow of ambient air in a recirculating path through the air passage without the ambient air being generally exhausted from the apparel conditioner system. The apparel is conditioned within a minimum amount of lapsed time. An enclosure door is included for providing an opening to access the inner surface of the outer enclosure for placing the apparel conditioning device within the enclosure. A plurality of housing supports are included for positioning the apparel conditioning device within the outer enclosure for providing the air gap channel.

In another embodiment of the invention a method for drying and deodorizing apparel with a flow of ambient air, includes the steps of; (1) providing a housing having an inlet, an outlet, an exterior surface and internal wall surfaces defining an air flow passage; (2) providing a fan in the inlet for forcing the ambient air to establish a flow of ambient air through the air flow passage by ambient air entering the inlet and exiting the outlet removed from the fan; (3) locating an adjustable apparel rack between the inlet and the outlet of the housing at an angle so that the flow of ambient air is directed through the apparel rack within the air passage; (4) placing the apparel on the support members to be positioned within the air passage; (5) positioning the apparel rack in the housing and adjusting the angle so that the flow of ambient air is directed to both exterior and interior surfaces of the apparel at the same time; and (6) adjusting a rotational speed of the fan, whereas a relatively minimum time is required for either one of drying and deodorizing the apparel.

The method may further include the steps of; (1) providing an outer enclosure having an enclosure door and an interior surface for receiving the housing inside the outer enclosure; (2) forming an air gap channel by displacing the external surface of the housing from the internal surface of the outer enclosure; and (3) recirculating the ambient air from the outlet of the housing to the inlet of the housing by using the air gap channel without discharging the ambient air to the exterior of the enclosure.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Referring now in more detail to the drawings, the invention will now be described in more detail. The apparel conditioner system of this invention includes an apparel conditioning device that can be used for drying and deodorizing apparel. For this description apparel includes anything worn by an individual as well as sporting gear and equipment (i.e. balls, gloves, rackets and the like). The apparel conditioning device is preferably supported inside an outer enclosure to comprise an improved apparel conditioner system used to improve the deodorizing of apparel along with drying the apparel. The apparel conditioning device includes a fan to force ambient air through an air passage defined within a housing of the apparel conditioning device. An adjustable apparel rack is positioned within the air flow passage using an adjustable rack mount. The position of the apparel rack is selected for supporting and holding the apparel such that a flow of ambient air can circulate to the inside surfaces of the apparel and envelop the outside surfaces of the apparel at the same time. The fan has a speed adjustment to obtain a velocity of the flow of the ambient air to improve the circulation in and envelopment around the apparel. The position of the apparel rack and the velocity of the ambient air flow is also important in the drying of apparel not having an interior surface, such as a ball.

Figure 1:
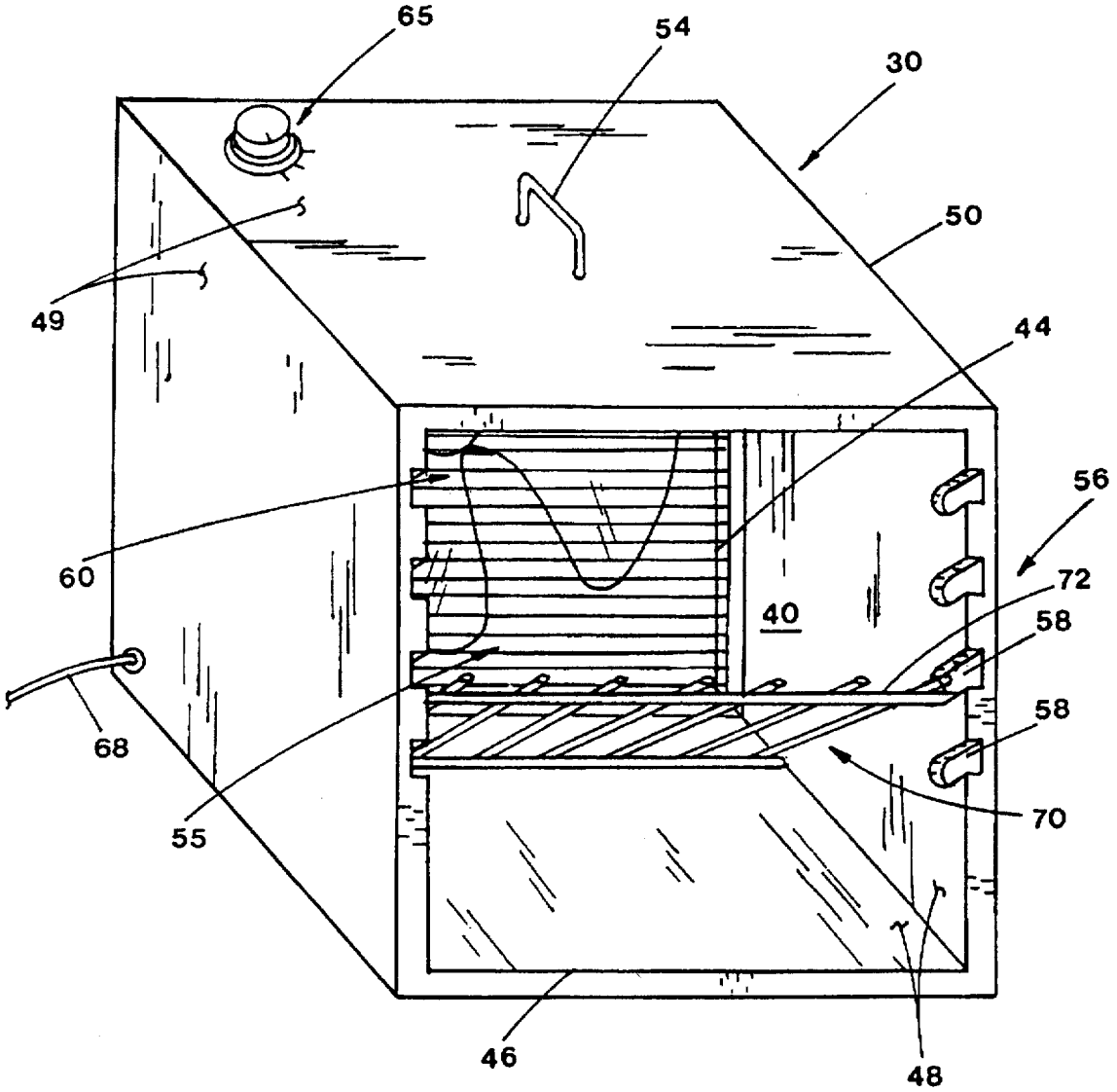
FIG. 1 is a perspective view of an apparel conditioning device of this invention.

The working portion of the apparel conditioner system is the apparel conditioning device illustrated in FIG. 1. The scope of this invention includes using the apparel conditioner device as a sub-combination device as well as the total apparel conditioner system being a combination including an outer enclosure to be discussed. The apparel conditioning device 30 includes a housing 50 having an inlet 44, an outlet 46 and interior wall surfaces 48 which form an air passage 40 within the housing. A flow of ambient air is provided by a fan 60 located in the inlet or opening end which forces the ambient air through the air passage to the outlet. An adjustable apparel rack 70 is positioned in the air passage 40 for supporting and holding an article of clothing or apparel. The apparel is placed on the adjustable rack within in the air passage to be directly in the flow of ambient air for improved conditioning of the apparel by the ambient air.

An adjustable rack mount 56 of the apparel conditioning device is provided to change the angle of the adjustable rack 70 with respect to the internal surface. The adjustable rack mount includes a plurality of rack rests 58 formed as cutouts in the housing near the outlet 46 as illustrated in FIG. 1. The rack mount also includes a rack support member 72 of the apparel rack 70 that engages respective rack rests to provide a plurality of positions possible for the adjustable apparel rack. Selection of the proper rack rests for the support member to engage is discussed in more detail later in this section and depends on the type, shape and size of the apparel item being conditioned.

The fan 60 in the inlet 44 of the housing has an fan control device 65 to adjust a speed of the fan and select a velocity of the flow of ambient air in the air passage. A power cable 68 can provide electrical energy for the fan from any convenient electrical outlet. Selection of the ambient air velocity provides another parameter for improved drying and deodorizing of apparel. The rack position and the fan speed combine to provide two adjustments to improve the effectiveness of the apparel conditioner system. A fan grill 55 protects the fan from damage, the apparel from getting into the fan and the user from physical harm. A housing handle 54 is provided to transport the apparel conditioning device 30. Rollers can be installed to the bottom of a large size device for enabling easy transport/movement of the device.

Figure 2:
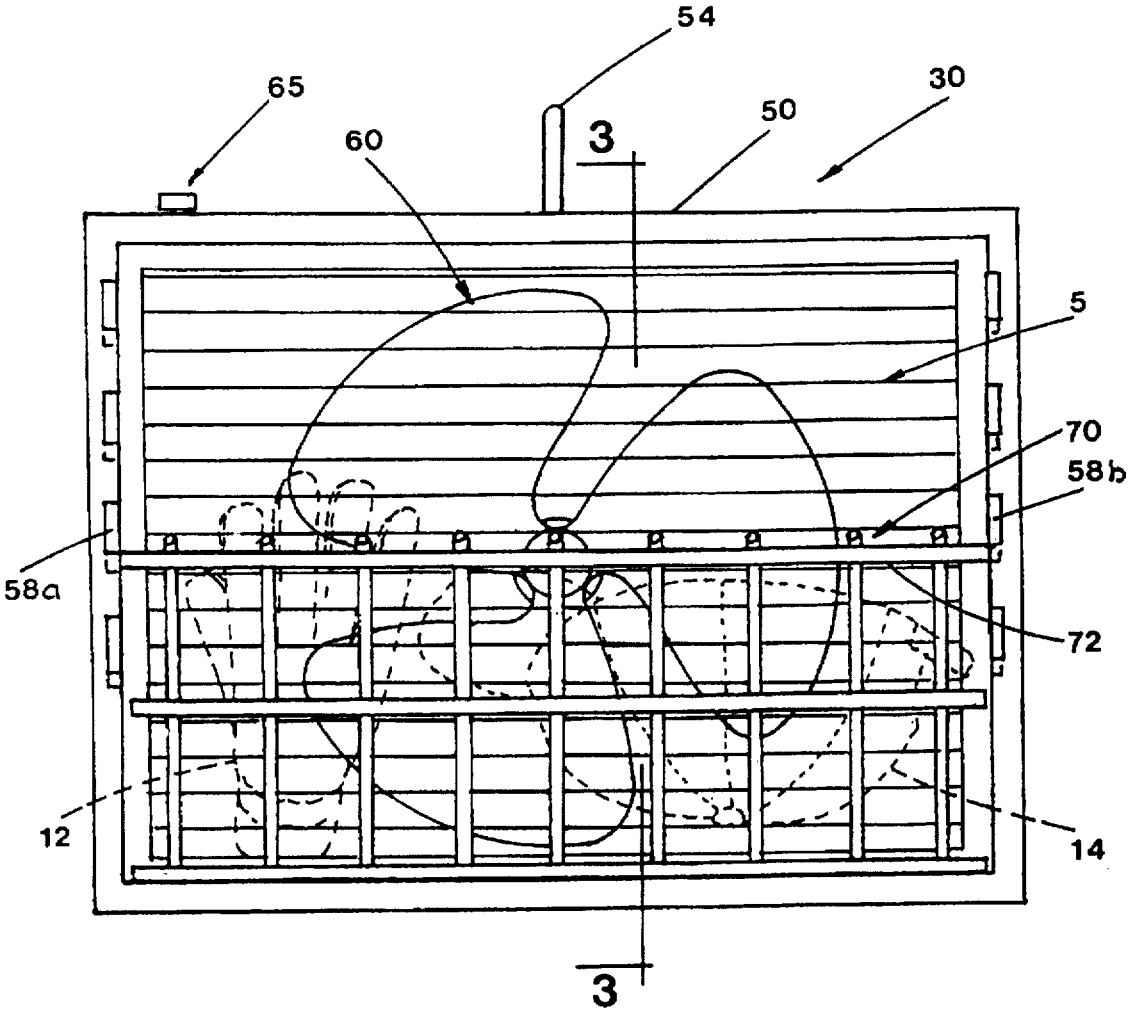
FIG. 2 is an end elevation view of an outlet of an elongated apparel conditioning device of this invention.

A elevation view of the air conditioning device 30 from its outlet is illustrated in FIG. 2. This view shows a glove 12 and a hat 14 as examples of apparel being supported and held by the adjustable apparel rack 70 within a housing 50. The rack is being held by the rack support member 72 engaging the rack rests 58*a* and 58*b* of the housing cutouts. This position of the rack has been selected to best allow the flow of ambient air to circulate inside the apparel when a fan 60 has its speed adjusted by the fan controls 65. The flow of ambient air also envelopes the outer surfaces of the glove and the hat according to this invention. This flow of ambient air drys and deodorizes the glove and hat. The apparel conditioning device is portable by using the housing handle 54 to transport the device.

Figure 3:
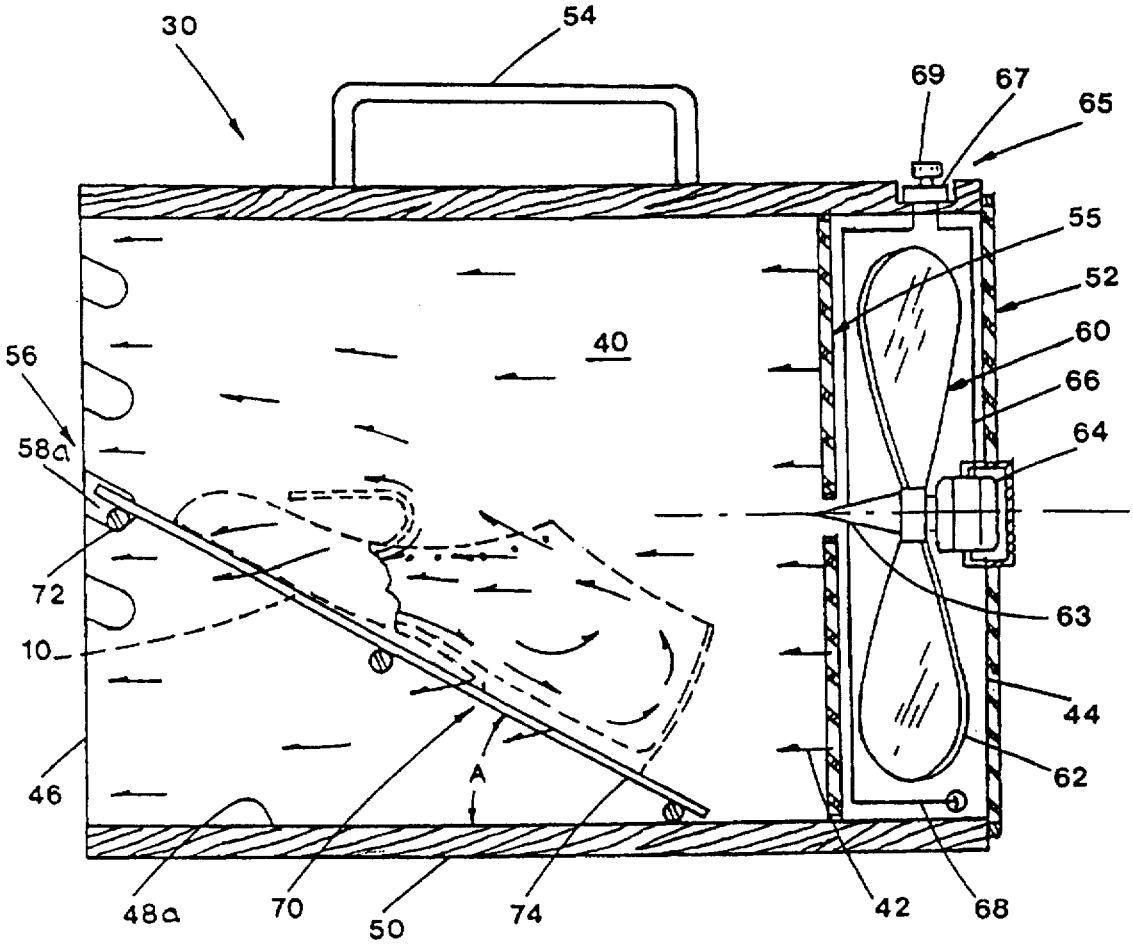
FIG. 3 is a cross sectional view of the elongated apparel conditioning device cut along line 3—3 in FIG. 2 and illustrating the flow of air within the device.

The flow of ambient air in the air passage 40 of the housing 50 of the apparel conditioning device 30 is illustrated in FIG. 3. This view is a cross-sectional view cut along the line 3—3 in FIG. 2. A plurality of air flow arrows 42 indicates the direction of the flow of ambient air at various locations in the air passage. The fan 60, having a fan blade 62 located adjacent an inlet 44 having an inlet grill 52 and a fan grill 55, establishes a parallel air flow near the fan in the air passage. The establishment of a parallel flow of ambient air is aided by a nose cone 63 added to the downstream side of the fan blade 62. A shoe 10 is used as an example of an article of apparel in FIG. 3 to illustrate the desired flow of ambient air in and around the apparel. The shoe is placed so that the ambient air penetrates inside the toe portion and circulates back to the heel portion of the shoe for improved drying and deodorizing. The apparel supporting members 74 support and hold the shoe at an angle "A" with respect to an a bottom wall surface 48*a* of the housing 50. The angle A is realized by the adjustable rack mount 56 including a rack rest 58*a* being engaged by a rack support member 72 that holds the apparel rack members 74 in the air passage 40 for positioning the apparel 10 supported on top of the rack members to be conditioned by ambient air in a minimum amount of lapsed time.

It is desirable to develop a turbulent flow of ambient air inside the apparel. The flow of air inside the apparel is made possible by having an open area of the apparel placed directly in the parallel flow of ambient air to entrap a portion of the ambient air inside the air passage 40 and divert this portion to the inside surfaces of the apparel. This entrapped portion of air will circulate within the apparel to become laden with moisture and foul air from the inside surfaces of the apparel before it is forced out from the inside of the apparel and discharged from the air passage at the outlet 46. Other portions of the parallel flow of ambient air inside the air passage will envelope the outside surfaces of the apparel and also become laden with moisture and foul air from the outside surfaces of the apparel before it is forced from the air passage at the outlet 46. For round sporting gear, such as a football, the ambient air will envelop the entire outer surface of apparel. The angle A of the apparel support members 74 is selected by the operator such that the apparel is conditioned within a respective minimum amount of lapsed time for a given velocity of ambient air fixed by the speed of the fan 62.

A power cable 68 to the fan motor 64 of the fan 60 is connected to fan controls 65 which include a switch and rheostat 67 controlled by a control knob 69. The rotational speed of the fan blade 62 determines a quantity of air flowing through the air passage per unit of time. The quantity of air determines how much moisture and foul air can be removed from the apparel in a given amount of time. The ability of moisture and foul air associated with the apparel to transfer to the air is also a function of the velocity of the ambient air adjacent the surfaces of the apparel. Too much velocity will not allow moisture and foul air to be transferred to the ambient air and too small a velocity will not remove moisture and foul air fast enough. In addition, the ability to force air to circulate inside the apparel is a function of the quantity of ambient air flowing in the air passage, and its velocity. There is an optimum fan speed corresponding to, and in concert with, an optimum angle of the adjustable apparel rack that can be achieved by trial and error to condition the apparel with a minimum amount of lapsed time. Each article of apparel, having a different size and shape, will have a different angle and fan speed for an overall optimum conditioning of the respective apparel article. Optimum conditioning is referred to in this discussion as an indication of a relatively short time period for conditioning apparel using only ambient air.

The fan grill 55 inside of the fan blade is provided to protect the operator's hand when placed in the air passage to remove apparel being conditioned. The fan grill also keeps articles from the fan blade 62, such as shoe strings. The accepted operating mode is to turn the fan off before reaching into the air passage, however, as an added safety feature the second inlet grill can be added to the apparel conditioning device.

The size of the apparel conditioning device can be selected to provide drying and deodorizing for a number of articles of apparel at the same time. Once again, apparel includes sporting gear and the like. The preferred size is on the order of a bread box to allow the device to be portable by the average user. The device can be made to dry a number of sporting gear at a time, such as baseballs. It is also within the scope of this invention to have more than one adjustable apparel rack positioned within the air passage at one time. This is possible only when the ambient air can be circulated to the inside exterior surfaces of each article of apparel and/or envelop the outside surfaces of the apparel. Each apparel rack would have an optimum position and the fan would have an optimum speed for each combination of different apparel. The preferred apparel conditioning device has a single adjustable apparel rack for conditioning the apparel in a relatively short period of time. For example, conditioning of the apparel overnight in the apparel conditioning device is easily accomplished.

Apparel can be placed on the adjustable apparel rack 70 by easily removing the rack from the air passage 40. The adjustable rack mount 56 allows easy removal of the apparel rack from the housing 50. The apparel is placed on the apparel rack outside of the housing and the rack is repositioned within the air passage having the apparel in its proper position on the apparel rack. The rack support member 72 is again placed in a selected rack rest 58 for initiation of the conditioning of the apparel.

Figure 4:
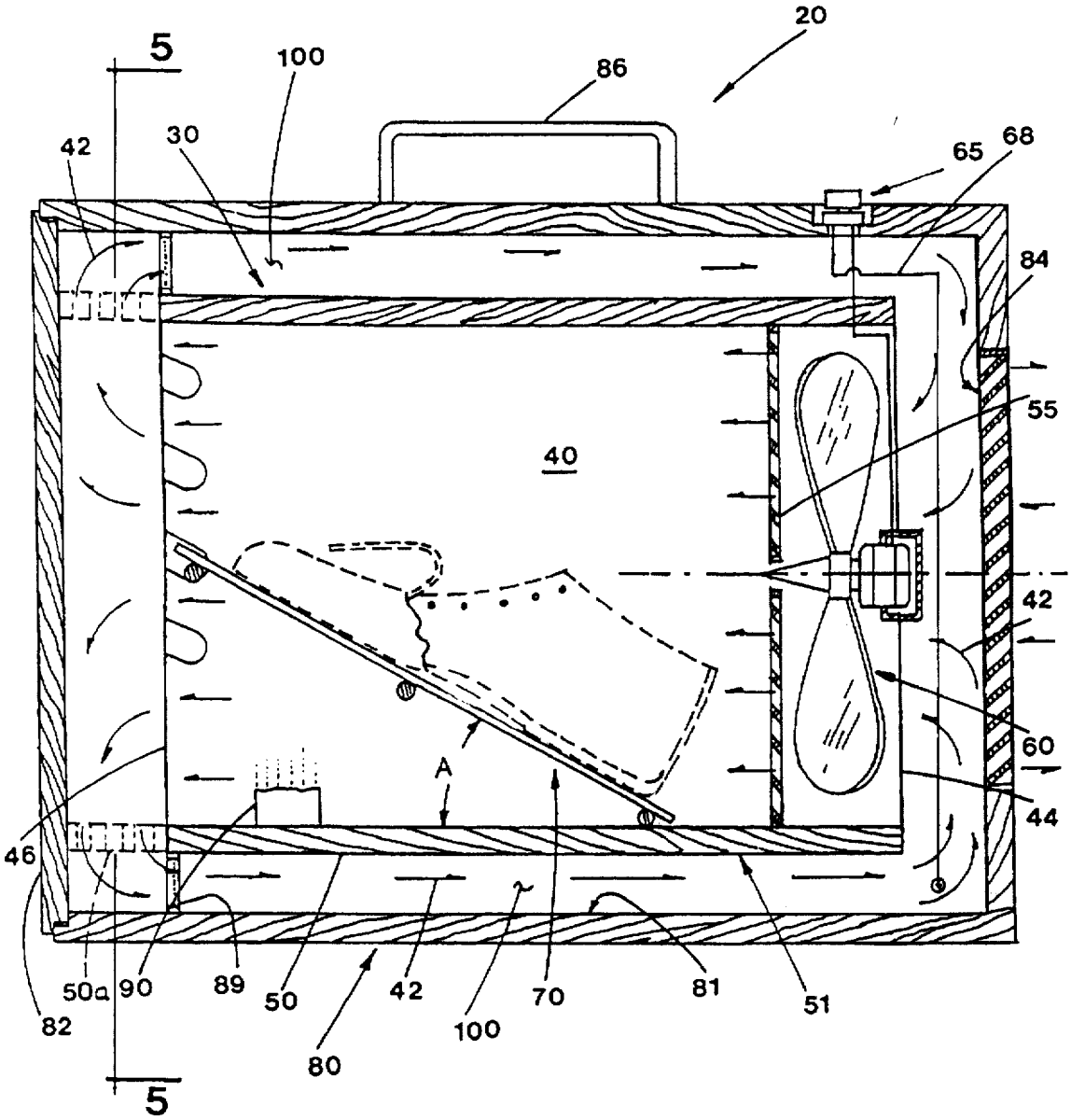
FIG. 4 is a cross sectional view of the apparel conditioning device of FIG. 3, plus an outer enclosure for recirculating air within the outer enclosure as illustrated.

A further embodiment of the present invention includes an outer enclosure to contain the apparel conditioning device such that the flow of ambient air can be recirculated as illustrated in FIG. 4. The outer enclosure 80 has an enclosure door 82 which is opened for receiving the apparel and the door is closed to completely enclose the apparel within the outer enclosure and the conditioning device. The housing 50 of the apparel conditioning device is carried by housing supports 88 that position the housing outer surfaces 51 away from enclosure inner surfaces 81 to provide an air channel 100 between the housing and the outer enclosure. Air flow direction arrows 42 indicate the direction of the flow of ambient air in the air passage 40 and the air channel 100. The fan 60 forces ambient air through the fan grill 55 at the housing inlet 44 and on through the air passage 40 to contact the apparel 10, to circulate inside the apparel and/or envelope the apparel before being discharged at the housing outlet 46. The inner surfaces 81 of the outer enclosure keep ambient air from being discharged into the area around the apparel conditioning device. The ambient air is forced to flow into parallel air channels 100 between the enclosure inner surfaces 81 and the housing outer surfaces 51. The ambient air is returned to the housing inlet to again be pulled into the fan grill 55 by the fan 60.

The outer enclosure has an enclosure handle 86 for transporting the complete apparel conditioner system 20 to a convenient location for being used. An enclosure grill 84 is provided in the outer enclosure for equalization of air pressure between the outside of the outer enclosure and the air gap channel. Air may flow through the enclosure grill as necessary for pressure control without affecting the recirculation of ambient air within the apparel conditioner system. The preferred flow of ambient air within the outer enclosure is to keep odor laden air (foul air) from being discharged to the area around the apparel conditioner system. A deodorizer 90 is placed within the enclosure to discharge fresh air to the ambient air being recirculated. The deodorizer will provide ambient air laden with particles of an odoriferous substance evaporated from the deodorizer (fresh air) to contact the apparel to efficiently deodorize the apparel in the apparel conditioner system for improved conditioning of the apparel. The amount of time normally spent in deodorizing apparel will be decreased by using a deodorizer.

The fan controls 65 located in the enclosure again provide an adjustment of the velocity of the flow of ambient air within the air passage, as illustrated in FIG. 4. A protective screen 89 can be provided between the outer enclosure 80 and the housing 50 to keep debris and other objects (i.e. shoestrings) from reaching the fan. The protective screen can be located in any convenient place to screen the ambient air recirculated through the air channel 100. An alternate embodiment includes the housing 50 having an extension **50*a* with openings for allowing air to recirculate without circulating debris through the system. The rotational velocity of fan 60 is adjusted by the fan controls to provide the most efficient operation for conditioning of the apparel within the apparel conditioner system 20. The angle A of the adjustable apparel rack 70 supporting and holding the apparel 10** is also adjusted to achieve the most optimum conditions for this embodiment of the invention.

Figure 5:
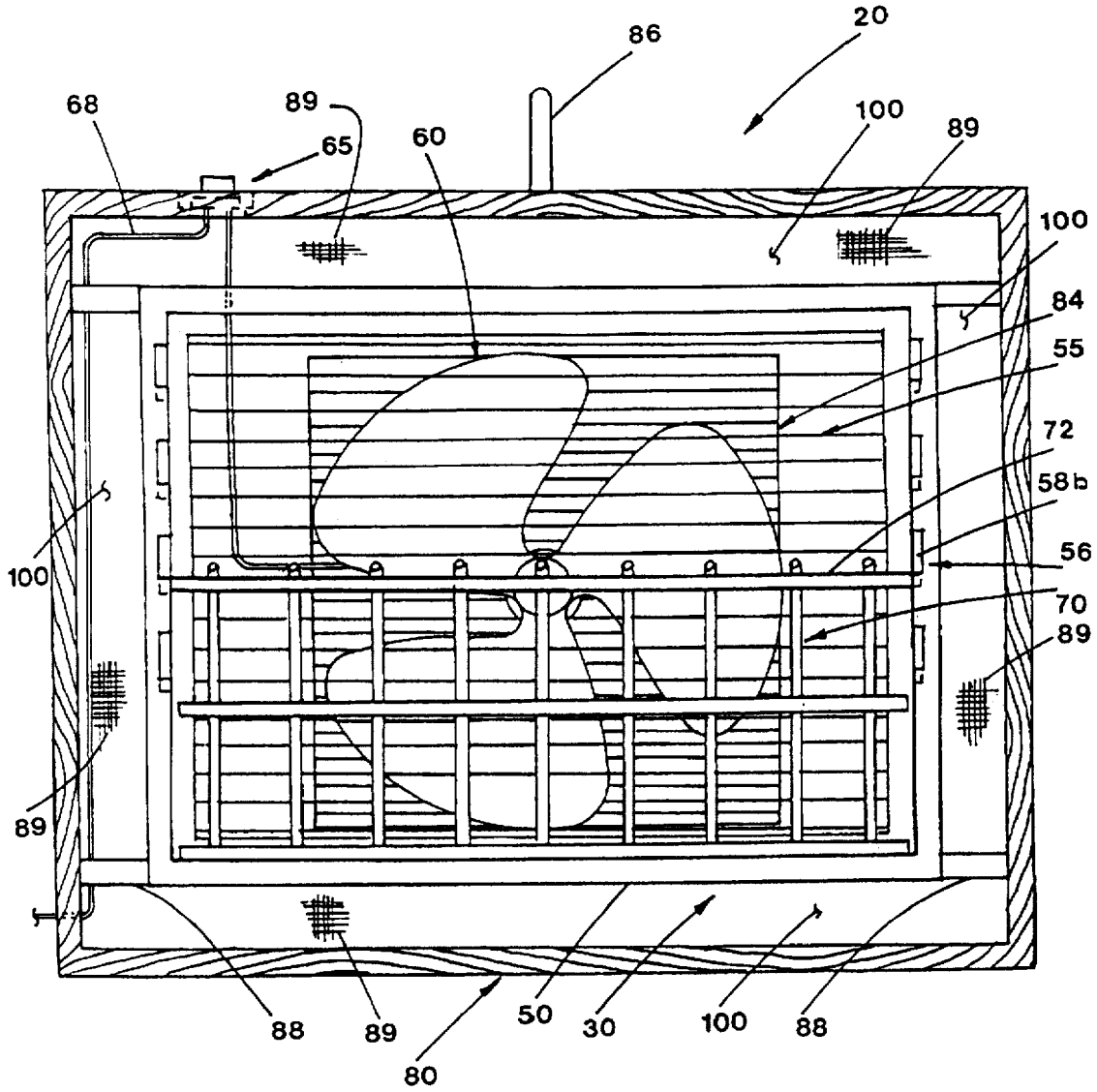
FIG. 5 is a cross sectional view of the apparel conditioning device of FIG. 4 cut along line 5—5 in FIG. 4.

A cross-sectional view of the complete apparel conditioner system 20 cut along line 5—5 in FIG. 4 is illustrated in FIG. 5. The air channel 100 is shown to exist to the exterior of all four sides of the housing 50 as provided by the housing supports 88. Protective screens 89 have been placed in the air channel. The enclosure grill 84 is carried by the enclosure 80 for equalizing pressures and fan grill 55 protects the user from physical harm. The adjustable apparel rack 70 is positioned directly downstream of the fan 60 for supporting and holding the apparel by providing an adjustable rack mount 56. Once again, the adjustable rack mount 56 includes a rack support member 72 that engages a rack rest 58. Fan controls 65 are carried by the outer enclosure 80.

Other embodiments of the apparel conditioner system include other adjustable rack mount means for supporting and holding the adjustable apparel rack. Any rack mount structure which will allow the angle of the apparel support members to be adjusted is essentially equivalent provided the system can be adjusted to function as disclosed and described. For example, a single vertical member located at the outlet of the housing can have a plurality of cutouts with each cutout for engaging and holding the rack support member in a selected location. In addition, an adjustable apparel rack includes any structure which allows the flow of ambient air to circulate inside an article of apparel and/or envelop the outside of the apparel while holding and supporting the apparel.

The housing and outer enclosure of the apparel conditioner system can be made of any material including wood, fiberglass, steel, plastic, aluminum and the like. The preferred material is laminated wood or sheet metal for economy of construction and durability during operation of the system. Standard components know in the industry can be used for the fan and fan motor, the inlet grill, the fan grill, the enclosure grill, the fan controls and the adjustable apparel rack.

While a preferred embodiment of the invention has been described using specific terms, such description is for illustrative purposes only, and it is to be understood that changes and variations may be made without departing from the spirit or scope of the following claims.

What is claimed is:

1. An apparel conditioner system for drying an deodorizing apparel with a flow of ambient air comprising:

an apparel conditioning device having housing with an external surface, an inlet and an outlet;

an air flow passage defined within said housing between said inlet and said outlet in which a flow of unheated ambient air is established to condition said apparel within said housing;

a fan carried by said housing and positioned in said inlet of said housing for forcing said flow of ambient air through said air flow passage;

an adjustable apparel rack carried within said housing for supporting said apparel in a position to be conditioned;

an adjustable rack mount for adjusting the position of said adjustable apparel rack in said air flow passage to be at an angle with respect to said housing to provide said flow of unheated ambient air within said air flow passage so that said flow of unheated ambient air provides circulation of air to inside surfaces of said apparel and envelops outside surfaces of said apparel at the same time for rapid drying;

an outer enclosure having an inner surface forming a chamber for receiving and containing said apparel conditioning device within said outer enclosure; and an air channel defined between said inner surface of said outer enclosure and said external surface of said housing so that said unheated ambient air is circulated within said air channel for providing said flow of unheated ambient air in a recirculating path defined by an internal air flow through said air passage and an external air flow through said air channel generally without being exhausted from said outer enclosure, whereby said apparel is conditioned within minimum amount of lapsed time without the use of a heating means.

2. The device set forth in claim 1, wherein said air flow passage within said housing is defined by:

a top wall, a bottom wall and space d apart side walls bridging said top and bottom walls;

said air flow passage having said inlet at one end and said outlet at another end for directing said flow of unheated ambient air in a parallel path from said inlet end to said outlet end to be recirculated within said air channel of said outer enclosure to return to said inlet end.

3. The device set forth in claim 2, wherein said bottom wall supports said apparel rack within said air flow passage at said angle with respect to said bottom wall; and said side walls including at least one side wall surface for containing a portion of said adjustable rack mount.

4. The system set forth in claim 2, wherein said adjustable rack mount includes:

a series of rack rests carried by said housing adjacent said outlet of said housing; and said adjustable rack includes a rack support to engage said rack rests for holding and supporting said rack within said air flow passage at said angle.

5. The system set forth in claim 4 wherein said series of rack rests are each formed by a cutout in said side wall surface of said housing and said rack support is formed by horizontal rack support member having at least one free end that engages a respective rack rest such that said angle is selected for said flow of unheated ambient air.

6. The system set forth in claim 1, wherein said flow of ambient air includes:

an internal air flow within said apparel for transferring moisture and foul air from said inside surfaces of said apparel to said ambient air: and an external air flow around said apparel for transferring moisture and foul air from said external surfaces of said apparel to said ambient air.

7. The system set forth in claim 1, including:

a power cable to provide electrical power to said fan;

an enclosure grill for equalizing pressures between the atmosphere and the ambient air inside the system;

an fan grill for protecting the user from physical harm and for keeping apparel from being damaged by said fan; and fan controls located in said enclosure having a switch and a rheostat, said fan controls being connected to said power cable for adjusting a speed of said fan to change a velocity of said flow of ambient air within said air passage, wherein said fan speed and said angle are both selected for improved conditioning of said apparel.

8. An apparel conditioner system for drying and deodorizing apparel with a flow of ambient air comprising:

a housing having an inlet, an outlet, an interior wall surfaces and an exterior surface an outer enclosure having an inner surface for receiving and containing said apparel conditioning device within said outer enclosure;

an air flow passage defined within said housing in which a flow of unheated ambient air is established;

a fan carried by said housing and positioned in said inlet to force said flow of unheated ambient air through said air flow passage;

an adjustable apparel rack carried within said housing for supporting said apparel in a position to conditioned; and an adjustable rack mount to position said adjustable rack in said air flow passage at an angle with respect to said interior surface of said housing to provide said flow of unheated ambient air within said air flow passage so that said flow of unheated ambient air at least envelops the outside surfaces of said apparel for conditioning said apparel within a reasonable amount of lapsed time without the addition of a heating unit to said device an air channel provided between said exterior surface of said housing and said inner surface of said outer enclosure for recirculating said unheated ambient air from said outlet of said housing to said inlet of said housing for providing a flow of ambient air in a recirculating path through said air passage without said unheated ambient air being exhausted from said outer enclosure.

9. The device set forth in claim 8, wherein said air flow passage defined within said housing comprises:

said interior wall surfaces for directing said flow of ambient air from said fan at said inlet to said outlet removed from said fan;

said interior wall surfaces including a bottom wall surface for supporting said apparel rack within said air passage at said angle with respect to said bottom wall surface; and said interior wall surfaces including at least one side wall surface for containing a portion of said adjustable rack mount.

10. The device set forth in claim 9, wherein said adjustable rack mount includes:

a series of rack rests formed in said side wall surface of said housing adjacent said outlet; and said adjustable rack includes a rack support to engage said rack rests for holding and supporting said rack within said air flow passage at said angle.

11. The device set forth in claim 10, wherein said series of rack rests are each formed by a cutout in said housing and said rack support is formed by a horizontal rack support member having at least one free end that engages a respective rack rest such that said angle is selected for said flow of ambient air.

12. The device set forth in claim 8, including:

a power cable for providing electrical power to said fan;

a switch having a rheostat connected to said power cable for adjusting a speed of said fan to change a velocity of said flow of ambient air within said air passage, wherein said fan speed is selected along with said angle for said improved flow of ambient air.

13. The device set forth in claim 8, including:

an enclosure door for providing an opening to place said apparel within said outer enclosure and said conditioning device.

14. The device set forth in claim 13, including:

a power cable to provide electrical power to said fan;

a fan grill for protecting a user from physical harm and for protecting said apparel from damage; and fan controls located in said housing having a switch and a rheostat, said fan controls being connected to said power cable for adjusting a speed of said fan to change a velocity of said flow of air within said air passage, wherein said fan speed and said angle are both selected for conditioning of said apparel.

15. The system set forth in claim 8, including a deodorizer placed within the outer enclosure that discharges particles of an odoriferous substance for providing fresh air to combine with said flow of ambient air for deodorizing said apparel.

16. An apparel conditioner device for drying and deodorizing apparel with a flow of ambient air comprising:

a housing having an inlet, an outlet, interior wall surfaces and an exterior surface;

an air flow passage defined within said housing in which said flow of ambient air is established;

a fan carried by said housing and positioned in said inlet to force said flow of ambient air through said air flow passage;

an adjustable apparel rack carried within said housing for supporting said apparel in a position to be conditioned;

an adjustable rack mount to position said adjustable rack in said air flow passage at an angle with respect to said interior surface of said housing to provide said flow of ambient air within said air flow passage so that said flow of ambient air at least envelops the outside surfaces of said apparel for conditioning said apparel within a reasonable amount of lapsed time;

said air flow passage defined within said housing comprises said interior wall surfaces for directing said flow of ambient air from said fan at said inlet to said outlet removed from said fan;

said interior wall surfaces including a bottom wall surface for supporting said apparel rack within said air passage at said angle with respect to said bottom wall surface;

said interior wall surfaces also including at least one side wall surface for containing a portion of said adjustable rack mount;

said adjustable rack mount includes a series of rack rests formed in said side wall surface of said housing adjacent said outlet;

said adjustable rack includes a rack support to engage said rack rests for holding and supporting said rack within said air flow passage at said angle; and said series of rack rests are each formed by a cutout in said housing and said rack support is formed by a horizontal rack support member having at least one free end that engages a respective rack rest such that said angle is selected for said improved flow of ambient air.

* * * * *